United States Patent [19]

Smith et al.

[11] 4,178,852

[45] Dec. 18, 1979

[54] DELAY ACTUATED EXPLOSIVE DEVICE

[75] Inventors: Don H. Smith, Dallas; Leslie W. Barton, Carrollton, both of Tex.

[73] Assignee: Atlas Powder Company, Dallas, Tex.

[21] Appl. No.: 828,910

[22] Filed: Aug. 29, 1977

[51] Int. Cl.[2] ..... F42B 3/10

[52] U.S. Cl. ..... 102/24 R; 102/27 R

[58] Field of Search ..... 102/24 R, 27 R, DIG. 9

[56] References Cited

U.S. PATENT DOCUMENTS

| | | | |
|---|---|---|---|
| 3,793,954 | 2/1974 | Johnston | 102/24 R |
| 3,926,119 | 12/1975 | Hurst et al. | 102/DIG. 9 |
| 4,023,494 | 5/1977 | Barton et al. | 102/24 R |
| 4,060,033 | 11/1977 | Postupack et al. | 102/27 R |

*Primary Examiner*—Verlin R. Pendegrass

*Attorney, Agent, or Firm*—Richards, Harris & Medlock

[57] ABSTRACT

A delay actuated explosive device for use in boreholes filled with high explosives is provided which comprises an explosive container having a detonator cord receiving conduit attached to the periphery thereof and a detonator receiving well which is offset from the detonator cord receiving conduit so as to avoid premature detonation. A detonator delay unit having an initiating means communicating with a delay detonator means is provided for use with the explosive container, the detonator delay unit being adapted such that the initiating means can be positioned proximate to the detonator cord conduit when the delay detonator means is positioned within the detonator receiving well of the explosive container.

5 Claims, 8 Drawing Figures

DELAY ACTUATED EXPLOSIVE DEVICE

BACKGROUND OF THE INVENTION

In one aspect this invention relates to explosive containers. In another aspect, this invention relates to an improved explosive device for delay activated explosives which are to be detonated by a detonator cord. In a further aspect, this invention relates to an explosive device for delay activating explosives which protects against premature detonation of the explosives.

In blasting, insensitive explosives or blasting agents such as ammonium nitrate-fuel oil compositions, for example, are detonated by booster or primer charges containing high explosives sensitive enough to be detonated by ordinary blasting caps. For safe and efficient use, the detonation of the primer charges used to initiate such blasting agents must be capable of being precisely timed and must be highly reliable. While electric blasting caps have the advantage of precise timing, the premature detonation of electric caps by thunderstorms, stray electric currents, static electricity or RF energy, has caused the industry to look to other means of detonating primer explosives, such as the use of nonelectric blasting caps in combination with millisecond delay fuses employing known pyrotechnic materials.

U.S. Pat. No. 3,420,173, issued to Slawinski, Jan. 7, 1969, discloses an axially expandable container defining grooves therein for receiving a detonator cord or a blasting cap held in place by a tubular sleeve disposed about the container. A similar device is taught by U.S. Pat. No. 3,789,760, issued to Griffiths, Jan. 5, 1974, wherein a plastic or cardboard sleeve defines a series of channels through which a detonator fuse may be threaded and blasting caps inserted to detonate the primer. A disadvantage associated with these types of devices, however, is that the energy released by the burning detonator cord adjacent to the container may be sufficient either to blow a hole in the container, causing the primer to malfunction, or detonate the primer prematurely. Another means for coupling the blasting cap to the outside of explosive cartridges is to separate the detonator fuse from the container by an energy absorbing media. Such a primer device is taught by Kern in U.S. Pat. No. 3,431,849, issued March 11, 1969. Even these devices, however, are not completely reliable, because, although they may prevent the energy released by the detonator fuse from prematurely exploding the container, the explosive force may nevertheless be sufficient to separate the sleeve and the blasting cap from the container, resulting in malfunction.

Thus, there is a continuing need for an explosive device which provides for delayed detonation of an explosive container using detonator cord means.

The present invention is directed to an explosive device for delay activated explosives which are to be initiated by a detonator cord. The explosive device of the present invention overcomes the deficiencies of the devices described above in that highly reliable timed delay detonation of explosive materials in a container is achieved by providing for: (1) initiation of a delayed detonator for the explosive container, (2) separation of the detonator from the detonating cord so as to prevent premature detonation, and (3) retention of unitary contact between the explosive container and the detonator after initiation thereof by detonating cord. According to the invention, a novel explosive device is provided for use with delay actuated explosives, which comprises:

an explosive container having a detonator cord receiving conduit and a detonator receiving well along an outer surface thereof and offset from the detonator cord receiving conduit; and a detonator delay unit having an initiating means communicating with the delay detonator means the delay unit being adapted in a manner so that the initiating means can be positioned proximate to the detonator cord conduit of the container when the delay detonator means is positioned within the detonator receiving well thereof.

The term "offset" as used herein is defined to mean that the detonator cord conduit and the detonator receiving well are not adjacent on the explosive container but rather are spatially separated on the periphery thereof in a manner such that the distance between them is sufficient to prevent premature detonation of the detonator as a result of the thermal and explosive energy of the detonating cord passing through the detonation cord conduit. The detonator receiving well of the explosive container is preferably located longitudinally along the outer periphery thereof but can be located on any outer surface of the container including an outer surface in the shape of a tube, for example, extending into the interior of the container having a closed end so as not to communicate with the interior of the container.

BRIEF DESCRIPTION OF THE DRAWINGS

A more complete understanding of the invention may be had by reference to the following detailed description when taken in conjunction with the accompanying drawings wherein.

DETAILED DESCRIPTION

Figure 1:
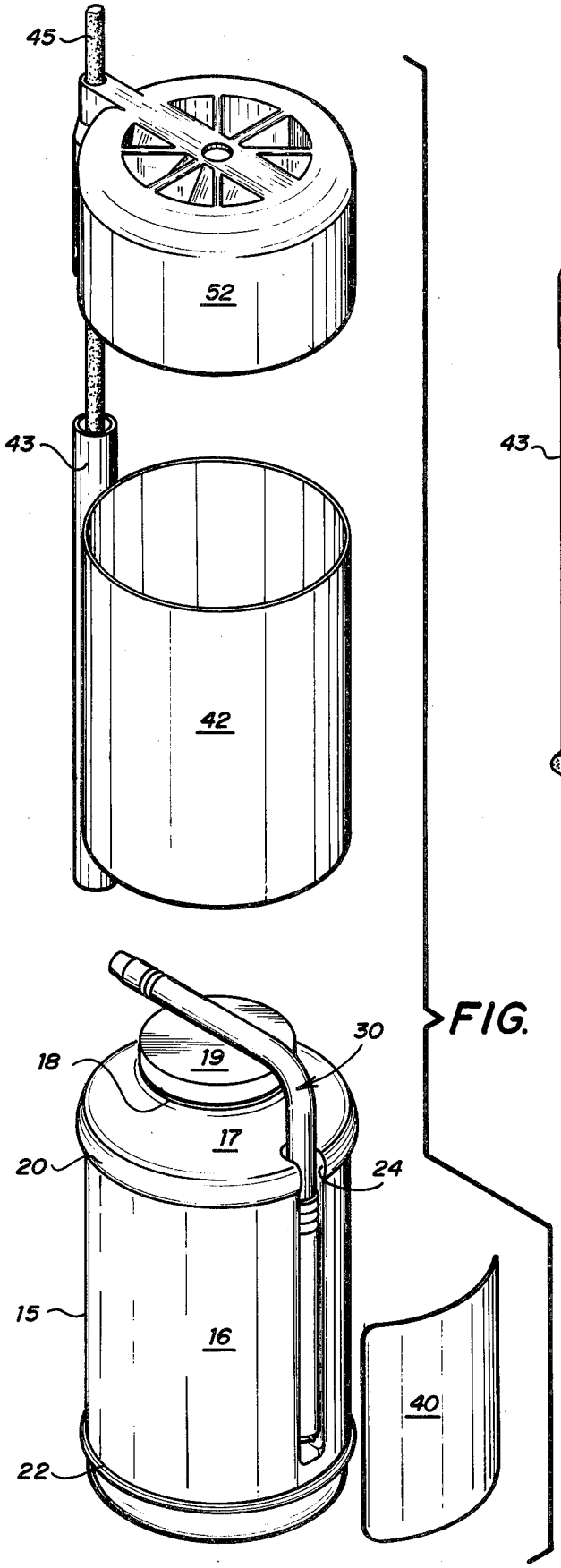
FIG. 1 is an exploded perspective view showing the explosive device of the present invention.

Referring to the drawings generally, there is shown an explosive device 10 for delay actuated explosives adapted to be initiated by a detonator cord. Generally, the explosive device 10 comprises an explosive container 15 which includes a detonator receiving well 24, a tubular sleeve means 42, with a detonator cord receiving conduit 43 affixed thereto, a delay detonator alignment means 52 and a delay detonator unit 30. The detonator cord 45 to be used in conjunction with the explosive device of the present invention is shown threaded through detonator cord conduit 43 and, in FIG. 2, knotted at the lower end thereof.

Figure 2:
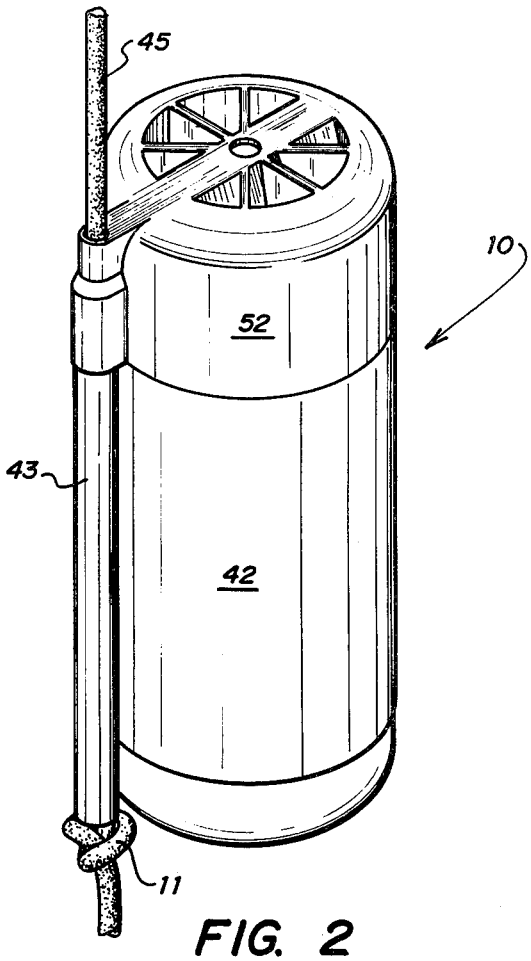
FIG. 2 is a perspective view of the explosive device of the present invention having detonator cord threaded therethrough and knotted.
Figure 8:
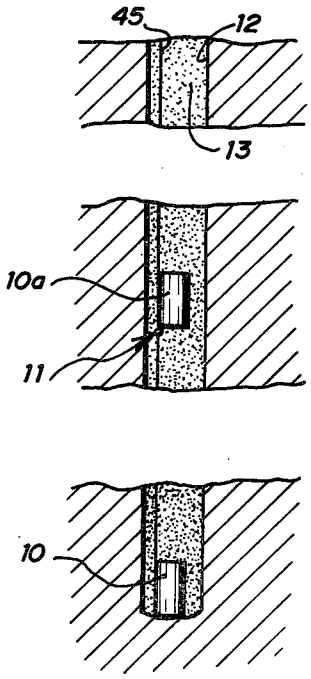
FIG. 8 is a fragmentary schematic showing a multiple of the explosive devices of the present invention positioned within a borehole.

The primary application of the explosive device of the subject invention is in the detonation of blasting agents or other primer sensitive explosives placed in boreholes. In such blasting operations it is many times desirable to control the initiation of the explosives placed in the borehole such that a series of separate blasts occur rather than one large blast, for example. To accomplish this result timed delay primers are used to initiate sequential portions of the blasting agents within the borehole by positioning them at spaced intervals and providing for delayed sequential detonation thereof. The explosive device of the present invention, when filled with high explosives and armed with a delay detonator unit can be used in such applications in the following manner. As shown in FIGS. 2 and 8 explosive device 10 can be threaded with a detonator cord 45 through delay detonator alignment means 52 and detonator cord conduit 43. After cord 45 passes through conduit 43, a knot 11 is tied in the lower end thereof to prevent slippage. The explosive device 10 is then lowered into the borehole 12 as shown in FIG. 8, and high explosives 13, such as for example ammonium nitrate-fuel oil compositions are positioned in close proximity thereto. At a predetermined interval, a second explosive device 10*a* may be threaded on detonator cord 45 and the cord again knotted and the explosive device lowered into the hole. In this manner a series of explosive devices 10 can be spaced throughout the depth of the borehole to be blasted and surrounded with a suitable blasting agent or other primer sensitive explosive composition. Upon ignition of the detonator cord the explosive devices 10 of the present invention will provide for a series of primer initiated explosions spaced fractions of a second apart at increasing or decreasing depths, as required for effective blasting in the particular application.

Referring now to the drawings and more particularly to FIG. 1 thereof, there is shown an exploded view of the explosive device of the present invention which comprises explosive container 15. Explosive container 15 can include a closed hollow body having a generally cylindrical midsection 16, a collar 17 and a threaded neck 18 to which a cap member 19 is threadably engaged. At the upper portion of midsection 16, where midsection 16 tapers into collar 17, explosive container 15 contains a shoulder 20, which is a radial projection from container 15 and integral with the same. At the lower end of midsection 16, adjacent the bottom of container 15, is defined an ankle 22, which is a radial ridge substantially contoured in the manner of shoulder 20. Disposed longitudinally along midsection 16 is an inwardly directed U-shaped detonator receiving well which is molded during the formation of midsection 16. Detonator receiving well 24 is dimensioned to receive a conventional blasting cap as will be described hereinafter in greater detail.

Container 15 can be the basic container disclosed in U.S. Pat. No. 4,023,494, issued to Barton et al., May 17, 1977. Such a container has a midsection formed of blow molded high density polyethylene with a thickness between 10 and 30 mils and has a collar and neck with a reinforced thickness of at least 40 mils. The reinforced collar and neck structure is formed by injection molding high density polyethylene. Cap 19 has cooperating threads defined in the interior thereof and a unique gasket structure to fit in sealing engagement with neck 18 to provide a fluid-tight seal for a slurry explosive to be placed within the container. Such a container can withstand pressures created by 50 feet of water and shock produced by dropping from a height of about 25 feet. The container 15 thus provides a sealed package for explosives which, when employed with the other components of the explosive device of the present invention, can be detonated without the necessity of puncturing or otherwise opening the sealed explosive package so as to expose it to the environment.

High explosives such as PETN, RDX, TNT, cap sensitive gels and emulsions, and two component explosives such as comminuted ammonium nitrate and nitromethane, as disclosed in U.S. Pat. No. 3,718,518, issued to Hurst, Feb. 27, 1973, can be used within the container 15 to provide a time delay primer charge for initiating blasting agents and other types of primer sensitive explosives.

In a preferred embodiment, a taping means 40 is affixed to midsection 16 of container 15 and is disposed across detonator receiving well 24 so that the detonator (to be further described hereinbelow) positioned within detonator receiving well 24 will not separate from container 15 before detonation thereof as a result of the energy released by the detonator cord, for example. Because of its great strength, an exemplary material from which taping means 40 can be produced is commercially available polyethylene woven fiber tape. Other commercially available high strength tapes can also be employed.

Further, with reference to FIGS. 1 and 2, a tubular sleeve 42 having a circumference slightly in excess of midsection 16 of container 15 is provided as additional protection for the delay detonator within detonator receiving well 24 and as support for detonator cord conduit 43. Tubular sleeve 42 can comprise a substantially cylindrical tube structure, manufactured from cardboard, paper or plastic, for example. Detonator cord conduit 43 is affixed along the exterior surface of tubular sleeve 42, for example, longitudinally along the length thereof. The detonator cord conduit can be formed from cardboard, plastic or other suitable materials that can be affixed to tubular sleeve 42 by gluing, stapling or other conventional means. When plastic is used to fabricate both tubular sleeve 42 and detonator cord conduit 43, the latter can be fabricated as a unitary portion of the former. Tubular sleeve 42 can be positioned on container 15 by forcing it down over shoulder 20 and onto midsection 16 of the container 15 where it is held in place by the circumferential ridges defining shoulder 20 and ankle 22 of container 15. The detonator cord conduit 43 has a cross-section sufficient to receive detonator cord 45 which is to be used in connection with explosive device 10 and extends upward above collar 17 of the container 15 (when tubular sleeve 42 is in place on container 15) so as to cooperate with the delay detonator alignment means described below.

The detonator cord 45 which is used in connection with the explosive device of the subject invention can be standard fast burning detonator cord such as 25 grain detonator cord, used in such applications. As illustrated in FIGS. 1, 2 and 8, detonator cord 45 is threaded through delay detonator alignment means 52 which cooperates with detonator cord conduit 43 and is knotted at the bottom end of the detonator cord conduit 43.

When tubular sleeve 42 is in position around container 15, detonator cord conduit 43 is spatially offset from the delay detonator receiving well 24 of container 15. Preferably, detonation cord conduit 43 is positioned on the opposite side of container 15 from delay detonator receiving well 24 so as to provide for maximum protection of the delay detonator from the energy released by detonating cord 45 passing through detonating cord conduit 43. However, any amount of offset, for example, from about one quarter to one half of the circumference of container 15, can be employed to separate detonator cord conduit 43 from delay detonator receiving well 24. Thus, the delay detonator unit to be employed with the explosive device of the present invention (which is further described hereinbelow) is spatially set apart from the detonator cord used to initiate it because of the fixed locations of the delay detonator receiving well 24 and the detonator cord conduit 43. Further, the delay detonator, which can comprise for example a conventional type blasting cap, is shielded from the energy expended by detonator cord 45 by detonating cord conduit 43, tubular sleeve 42, and taping means 40. Both tubular sleeve 42 and taping means 40 cooperate to insure that ignition of detonator cord 45 does not dislodge the detonation delay unit 30 from the explosive container. Thus, even if the entire tubular sleeve 42 should be blown away from the container by the explosive force of detonation cord 45, taping means 40 will retain the detonation delay unit within detonation delay receiving well 24 of container 15 so that proper detonation of the cap sensitive explosives contained therein will be achieved.

Figure 3:
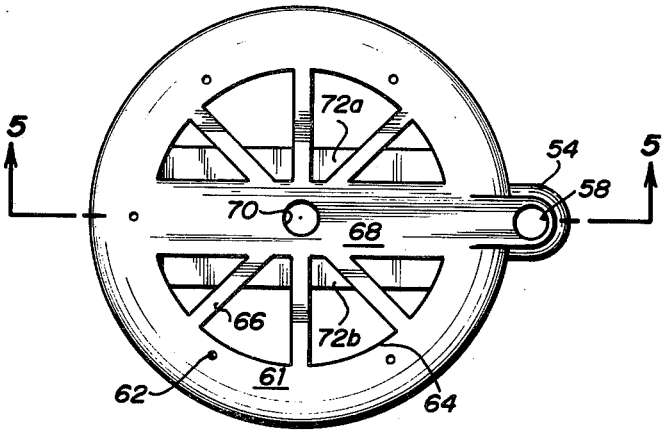
FIG. 3 is a top view of the delay detonator alignment means.

Now referring specifically to FIGS. 3–5, a delay detonator alignment means 52 will be described in detail. In a preferred embodiment of the present invention an L-shaped detonator delay unit is employed which comprises an initiating means communicating with a delay detonator means. In this preferred embodiment of the present invention delay detonator alignment means 52 is employed for the purpose of positioning, and holding in position, a detonator delay unit such that the initiating means thereof is positioned proximate the detonator cord conduit 43 of tubular sleeve 42 when the detonator delay portion of the delay detonator unit is positioned within the detonator receiving well 24 of container 15. The unique construction of delay detonator alignment means 52 provides for the rapid and accurate positioning of the initiating means of the detonator delay unit proximate the upper end of the detonator cord conduit 43 while securing a delay detonator means (such as a conventional blasting cap in combination with pyrotechnic delay means) within detonator receiving well 24 of container 15. Further, the alignment means 52 provides protection for the detonator delay unit itself (further discussed below), as well as the crucial transfer area where energy from the detonating cord is transferred to the initiating means of the detonator delay unit.

Figure 4:
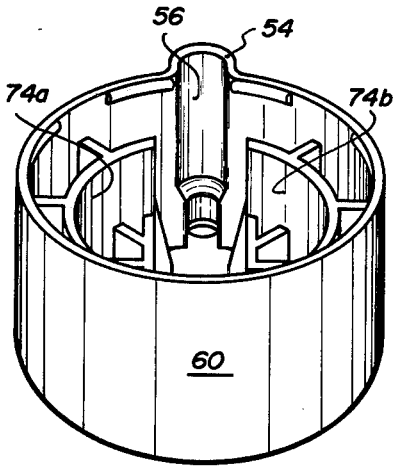
FIG. 4 is a bottom perspective view showing the interior of the delay detonator alignment means.

As depicted in FIG. 4, delay detonator alignment means 52 comprises a cylindrical wall 60, of a slightly larger diameter than that of container 15. Cylindrical wall 60 extends radially inward at the top of alignment means 52 to form lip 61, as shown in FIG. 3 (a top view of alignment means 52). A rib 54 extends outwardly from cylindrical wall 60, longitudinally thereof, and defines a corridor 56 communicating with the interior of cylindrical wall 60 (as best shown in FIGS. 4 and 5). The top surface of rib 54 defines a circular opening 58 having a circumference slightly greater than the detonator cord 45 which is being employed with the explosive device of the subject invention. Detonator cord 45 can be threaded through opening 58 and corridor 56 and into detonator cord conduit 43 which extends above collar 17 of container 15 and partially into delay detonator alignment means 52 when the latter is snapped in place on container 15 as further described below.

Lip 61 of cylindrical wall 60 contains a series of small air outlets 62 which permit the escape of air trapped within the interior of alignment means 52 when the explosive device is to be used under water. Alignment means 52 also defines a plurality of pie-shaped ports 64 providing air openings between lip 61 and bridge 68 which extends radially across the diameter of the alignment means, in alignment with ridge 54. Air hole 70, in bridge 68, provides for the release of air in the same manner as openings 62, described above. The pie-shaped ports 64 are separated by a series of webs 66 which lends structural support to the alignment means 52.

Figure 5:
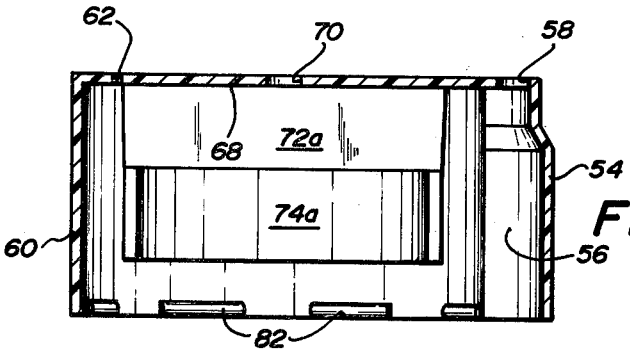
FIG. 5 is a section view of the delay detonator alignment means shown in FIG. 3 taken along the line 5—5.

Referring specifically to FIGS. 4 and 5, the interior arrangement of alignment means 52 will be described in detail. The interior surface of bridge 68, described above, defines a path along which that portion of the detonator delay unit which provides communication between the initiating means thereof and the delay detonator means thereof lies once explosive device 10 is ready for use. In order to hold this intermediate portion of the delay detonator unit in position, a generally U-shaped channel is formed having bridge portion 68 as the closed end thereof and channel walls **72*a* and 72*b* as the side walls thereof. Preferably, channel walls 72*a* and 72*b* angle outward from bridge 68 so that the open end of the U-shaped channel presents a wide area within which the intermediate portion of the delay detonator unit will be engaged, the channel substantially narrowing as it approaches bridge 68 so that once alignment means 52 is snapped in place (as described hereinbelow) the channel formed by bridge 68, and channel walls 72*a* and 72*b*** provides little space for free movement of the detonator delay unit.

Channel walls **72*a* and 72*b* are structurally reinforced by the aforementioned webs 66 which extend radially toward the center of alignment means 52. Arcuate supporting walls 74*a* and 74*b* cut through webs 66 within the interior of alignment means 52 at a diameter slightly larger than that of cap means 19 of container 15. Arcuate walls 74*a* and 74*b* are, of course, slotted at channel walls 72*a* and 72*b*** to provide for the passage of the intermediate portion of the detonator delay unit into the alignment channel previously described.

Along the lower periphery of the interior of cylindrical wall 60 are defined locking ridges 82. Locking ridges 82 are designed to pass over shoulder 20 of the container 15 when alignment means 52 is compressed onto container 15 to abut with shoulder 20. Alignment means 52 cooperates with container 15 in a manner such that locking ridges 82 allow for a "snap-on" and "snap-off" arrangement. When the alignment means 52 is snapped onto container 15 detonator cord conduit 43 will extend upward into corridor 56 of ridge 54 and cap means 19 will rest within arcuate walls 74 and the top of cap means 19 will close the open end of the U-shaped alignment channel defined by bridge 68 and channel walls **72*a* and 72*b*** described above.

Figure 6:
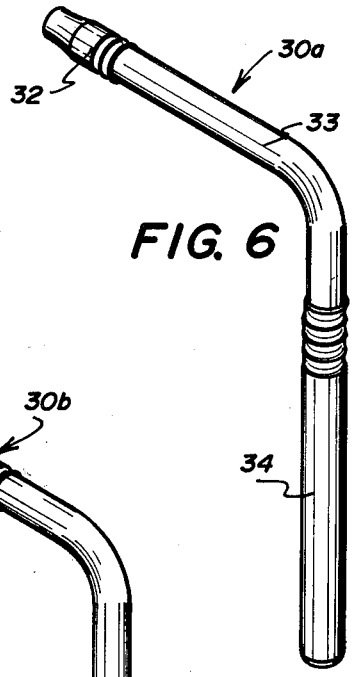
FIG. 6 is a perspective view of one embodiment of the detonator delay unit.

While a variety of detonator delay units can be employed with the explosive device of the present invention, two preferred embodiments of detonator delay units will now be described with relation to FIGS. 6 and 7. Thus, referring to FIG. 6, a detonator delay unit **30*a* is depicted which comprises an initiation means such as a small primer charge 32 acoustically coupled by means of the connecting member 33 to a delayed detonating means 34. Delay detonator means 34 can comprise a blasting cap in combination with a precisely timed millisecond delay means which can be any of a variety of pyrotechnic chemicals conventionally used in the industry. Connecting member 33 can comprise a rigid L-shaped hollow tubular element manufactured from a suitable material such as polyethylene which receives the delay detonator, comprising the delay pyrotechnic chemicals and a blasting cap at one end thereof, and the initiating means, comprising a primer charge 32, at the other. Primer charge 32, which detonates with the explosive force equivalent to a small rifle primer, is positioned next to detonator cord 45 and is detonated by energy released from the ignited cord. The delay detonator means 34 can comprise a No. 6 or 8 delay fuse blasting cap which detonates with sufficient force to detonate explosive container 15. The L-shaped detonation delay unit provides for the necessary separation between detonator cord 45 and delay detonator 34** when the detonation delay unit is combined with the explosive device of the present invention as further described below.

Figure 7:
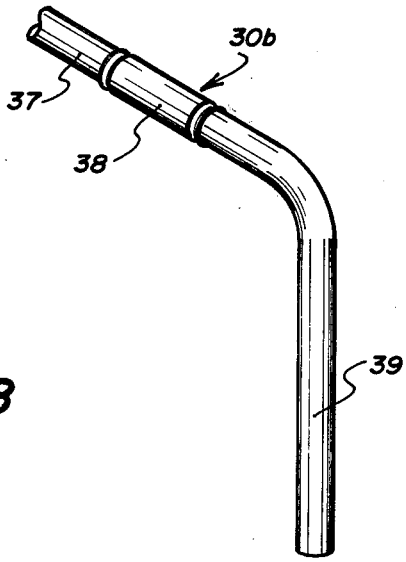
FIG. 7 is a perspective view of another embodiment of the detonator delay unit.

FIG. 7 depicts an alternate embodiment of a detonator delay unit **30*b* which also can be employed with the explosive device of the present invention. In place of a primer charge 32 described above, a length of 7-grain detonator cord 37 is positioned near the detonator cord 45. A delay element 38 is crimped onto one end of 7-grain cord 37. The delay element is a cylindrical copper casing containing a commercially available pyrotechnic delay compound which burns slightly slower than the 7-grain detonator cord. The other end of the delay element 38 is crimped to a length of 50-grain detonator cord 39. The 50-grain detonator cord supplies sufficient blasting power to initiate the explosives in container 15**.

Either of the above described L-shaped detonator delay units can be used in combination with the explosive device of the present invention in the following manner. Explosive container 15, filled with a cap sensitive primer explosive and sealed with cap means 19, can be armed for use in the following manner. The delay blasting cap portion of the L-shaped detonation unit of one of the L-shaped detonation delay units described above is inserted in detonator receiving well 24 of container 15 and is held in place by tape means 40 and tubular sleeve 42. At this point, the initiating means of the detonator delay unit is swung into position generally over the top of detonating cord conduit 43 which is affixed to sleeve 42 and is offset (preferably 180 degrees) from the detonator receiving well 24 of container 15. Delay detonator alignment means 52 can then be placed over the top of detonator delay unit 30 and explosive container 15. The outward slant of channel walls **72*a* and 72*b* provide for the alignment of the horizontal intermediate portion of the L-shaped detonator delay unit 30 such that the initiating means thereof is positioned adjacent the upper end of detonator cord conduit 43. Rib 54 of alignment means 52, which provides corridor 56, insures that alignment means 52 is in correct rotational position on top of container 15. Gentle downward pressure on alignment means 52 will cause locking ribs 82 to snap over shoulder 20 of the explosive container. Detonator cord can now be threaded through opening 58 of rib 54 and into detonator cord conduit 43** and knotted at the bottom end thereof as described hereinabove.

Although preferred embodiments of the invention have been illustrated in the accompanying drawings and described in the foregoing detailed description, it will be understood that the invention is not limited to the embodiments disclosed but is capable of numerous rearrangments, modifications and substitutions of parts and elements without departing from the spirit of the invention.

We claim:

1. An explosive device for use with delay actuated explosives, adapted to be initiated by a detonator cord, comprising:

a water proof container for containing delay actuated explosives, said container having a substantially flat bottom section and a substantially cylindrical mid section, said mid section defining a U-shaped detonator receiving well along an outer surface thereof longitudinally along its length, said container also having a top portion integral with said mid section terminating at a threaded tubular neck;

a container cap having threaded means on the interior thereof adapted to threadably cooperate with threads on the neck of said container in sealing engagement therewith;

a tubular sleeve disposed about the mid section of the container and comprising a detonator cord conduit affixed thereto and offset from said detonator receiving well of said container;

a detonation delay unit having an initiating means adapted to be positioned proximate said detonator cord conduit and a delay detonating means for detonating said container, said delay detonating means communicating with said initiating means, and said delay detonating means being disposed in the detonator receiving well of said container;

a protective tape retaining means covering said detonator receiving well, and between said container and said tubular sleeve for holding said detonating means in position during ignition of the detonating cord passing through said detonating cord conduit; and an alignment means removably affixed to the top of said container and extending over a portion thereof, said alignment means having a substantially cylindrical shape and comprising in the interior thereof, channel wall means for aligning said initiating means with said detonator cord conduit and for securing said delay detonator means within said detonator receiving well, when said alignment means is mounted onto said container, said alignment means also comprising an interior corridor parallel to the axis thereof, said corridor communicating with the detonating cord conduit affixed to said tubular sleeve, and a lip formed by the top of said alignment means extending radially inwardly and having a plurality of air outlets for allowing the escape of air from the interior of said alignment means.

2. The explosive device of claim 1 wherein said container comprises a cap sensitive mixture of granular ammonium nitrate and nitromethane.

3. The explosive device of claim 2 wherein the initiating means of said detonator delay unit comprises a small primer charge and said detonating means comprises a delay fuse blasting cap.

4. The explosive device of claim 3 wherein said initiating means and said detonating means are connected by a hollow tubular structure.

5. The explosive device of claim 2 wherein said initiating means comprises a length of detonator cord and said delay detonator means comprises a pyrotechnic delay element in combination with 50-grain detonating cord.

* * * * *